US007219526B2

(12) United States Patent
Herod

(10) Patent No.: US 7,219,526 B2
(45) Date of Patent: May 22, 2007

(54) PORTABLE PNEUMATIC COMPRESSION RIVETER

(76) Inventor: James R. Herod, 602 Quail Creek, Perry, OK (US) 73077

( * ) Notice: Subject to any disclaimer, the term of this patent is extended or adjusted under 35 U.S.C. 154(b) by 435 days.

(21) Appl. No.: 10/869,731

(22) Filed: Jun. 16, 2004

(65) Prior Publication Data

US 2006/0243020 A1 Nov. 2, 2006

(51) Int. Cl.
*B21J 15/34* (2006.01)
*F16J 1/00* (2006.01)

(52) U.S. Cl. ..... 72/453.07; 72/391.2; 72/453.16; 29/243.53

(58) Field of Classification Search ..... 72/453.06, 72/453.07, 452.8, 453.16, 453.17, 453.19, 72/452.7; 29/243.53
See application file for complete search history.

(56) References Cited

U.S. PATENT DOCUMENTS 2,355,520 A * 8/1944 Fischer et al. ..... 72/441
2,467,020 A * 4/1949 Fischer ..... 72/445
3,323,346 A * 6/1967 Spangler et al. ..... 72/452.8
3,877,280 A * 4/1975 Cornell ..... 72/387
3,999,352 A * 12/1976 Doke ..... 403/282
5,284,044 A * 2/1994 Bier ..... 72/453.07
6,978,526 B1 * 12/2005 Lin ..... 29/243.525
7,107,814 B2 * 9/2006 Winterhalter et al. .... 72/453.07

OTHER PUBLICATIONS

Chicago Pneumatic Tool Company, Compression Riveter CP0351 Parts Manual, Mar. 1999, P122454 Rev. C, pp. 1-13.*

* cited by examiner

*Primary Examiner*—David B. Jones
(74) *Attorney, Agent, or Firm*—Molly D. McKay

(57) ABSTRACT

A portable pneumatic compression riveter consists of a valve, air cylinder and rivet head assembly consisting of an alligator style set of jaws or a c-yoke style jaw set that is used to upset solid rivets used primarily, but not limited to, the aerospace industry. Disclosed is a series of improvements that make the tool lighter, more reliable and safer to operate.

5 Claims, 12 Drawing Sheets

PORTABLE PNEUMATIC COMPRESSION RIVETER

BACKGROUND OF THE INVENTION

1. Field of the Invention

This invention relates generally to portable pneumatic tools and, more particularly, to compression riveters, used to install solid rivets primarily but not limited to the aerospace industry.

2. Description of the Related Art

Portable pneumatic compression riveters are used to install solid rivets to join parts together. They consist of a valve assembly, cylinder assembly with at least one compression chamber and a head assembly consisting of an alligator style set of jaws or a c-yoke style jaw set. An air line with approximately 90 psi compressed air is connected to the valve. The valve is manually actuated by means of a lever allowing compressed air to enter the cylinder assembly. Inside the cylinder, a piston with a seal and a wedge attached to the front is driven forward by the compressed air. The wedge is driven between a set of bearings mounted within the jaws of the rivet head assembly. The wedge forces the pivoting jaw to pivot about a center pin resulting in a squeezing action out on the end of the pivoting jaw as it closes with the fixed jaw. This squeezing action is the means to upset the rivet to join parts together.

To function most effectively, the valve assembly and cylinder assembly must not leak air. The cylinder material must be both capable of handling the air pressure required to operate the tool and hard enough to resist the wear of the piston. The wedge must be properly aligned with the bearings mounted in the rivet head assembly and capable of handling the resultant forces from upsetting the rivet. A needle roller bearing is typically used with the pivot pin from which the pivoting jaw pivots about. Crushing these needle rollers has long been a limiting factor for this type of tool.

Another shortcoming of the portable pneumatic compression riveters produced today is the potential for catastrophic failure of the pivoting jaw which can lead to injury or damage to the work being assembled when the forward portion of the pivoting jaw reaches its fatigue limit and breaks off from the attached portion at or around the pivot pin area.

One of the major reasons for these shortcomings is the need to make the portable pneumatic compression riveter as light as possible for ergonomic reasons. An improved portable pneumatic compression riveter which addresses these problems and shortcomings of earlier work in this field would be an important technological advance.

It is an object of the invention to provide a portable pneumatic compression riveter which addresses some of the problems and shortcomings of the prior art.

Another object of invention is to provide such a portable pneumatic compression riveter which addresses cylinder, piston and seal wear issues while contributing to a lighter and more reliable seal design.

Another object of the invention is to provide such a portable pneumatic compression riveter which allows for a greater misalignment between the wedge and the bearings in the rivet head assembly and further contributes to reducing the weight of the tool.

Another object of the invention is to provide such a portable pneumatic compression riveter which addresses the problem of crushed needle roller bearings at the pivot pin by utilizing a hardened steel sleeve in place of the needle roller bearing. This further contributes to a lighter, more reliable and compact tool.

Another object of the invention is to provide such a portable pneumatic compression riveter which reduces the chance of catastrophic failure of the pivoting jaw thus reducing the chance of injury or damage to the work being assembled.

Another object of the invention is to provide such a portable pneumatic compression riveter which utilizes a composite valve body to further reduce the weight of the tool. How these objects are accomplished will become apparent from the following descriptions and from the drawings.

SUMMARY OF THE INVENTION

Portable pneumatic compression riveters consist of a valve assembly, cylinder assembly with at least one chamber and a head assembly consisting of an alligator style set of jaws or a c-yoke style jaw set. An air line is connected to the valve assembly. The valve is manually actuated by means of a lever allowing air to flow into the cylinder. In the improvement the valve body is of a composite material with an integrated handle improving ergonomics and significantly reducing the weight. The bulkheads separating the chambers in the cylinder assembly are also made of a composite material that seals each chamber with an o-ring and quad-ring. The pistons are also made of a composite material and used with one or more u-rings to seal the piston—cylinder assembly. Use of the u-rings allows the use of an aluminum cylinder with the composite pistons taking most of the wear. The u-rings allow for a significantly larger amount of wear than does a piston with an o-ring; this contributes significantly to extend the service life interval. Further, since composite pistons are used, the cylinder can be made of aluminum without the benefit of hard anodize applied to the interior of the cylinder or using a steel cylinder to address cylinder wear and seal problems.

In another aspect of the invention, the wedge is pinned within a clevis that is mounted to the face of the piston. The wedge, driven forward by the compressed air behind the piston, is forced between a set of bearings causing the pivoting jaw to pivot about the center pin resulting in a squeezing action out on the end of the pivoting jaw as it closes with the fixed jaw. In the improvement, the wedge has angled flats on the nose which allow the wedge to self align as it moves forward rather than bind in the rivet head assembly. The wedge's construction is such that it is pocket milled on both sides creating an I-beam cross section which contributes to a lighter tool.

In another aspect of the invention, an improvement is made by utilizing a hardened steel sleeve, instead of a needle roller bearing at the pivot pin, to eliminate the problems with crushed needle rollers and also contribute to a lighter, more reliable and compact tool.

In yet another embodiment of the invention, an improvement is made by adding a hollow recess to the pivoting jaw just above and behind the pivot pin with the purpose of allowing a fatigue crack to propagate into the hollow recess thus preventing a catastrophic failure of the forward portion of the pivoting jaw from becoming a projectile that could cause injury to the operator or damage to the work being assembled.

Further details of the invention are set forth in the following detailed descriptions and in the drawings.

DETAILED DESCRIPTION OF PREFERRED EMBODIMENTS

Figure 1:
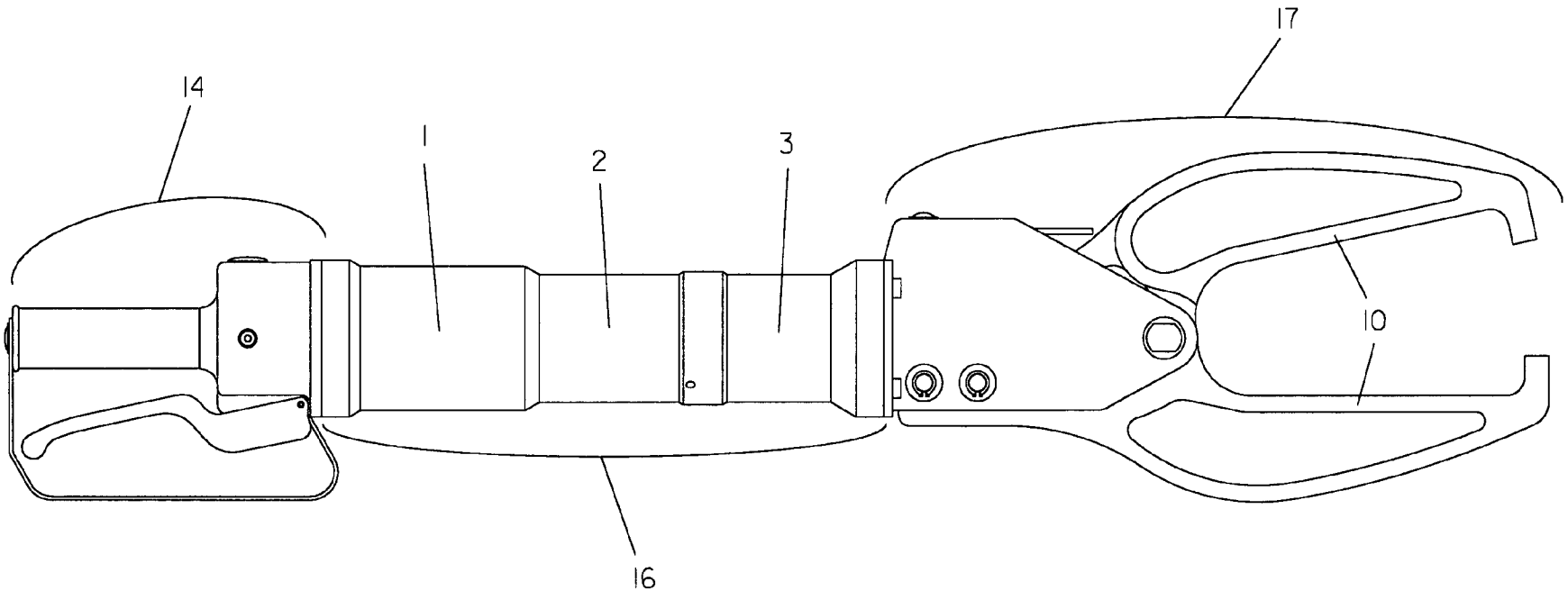
FIG. 1 is a representative side view of an exemplary portable pneumatic compression riveter.
Figure 2:
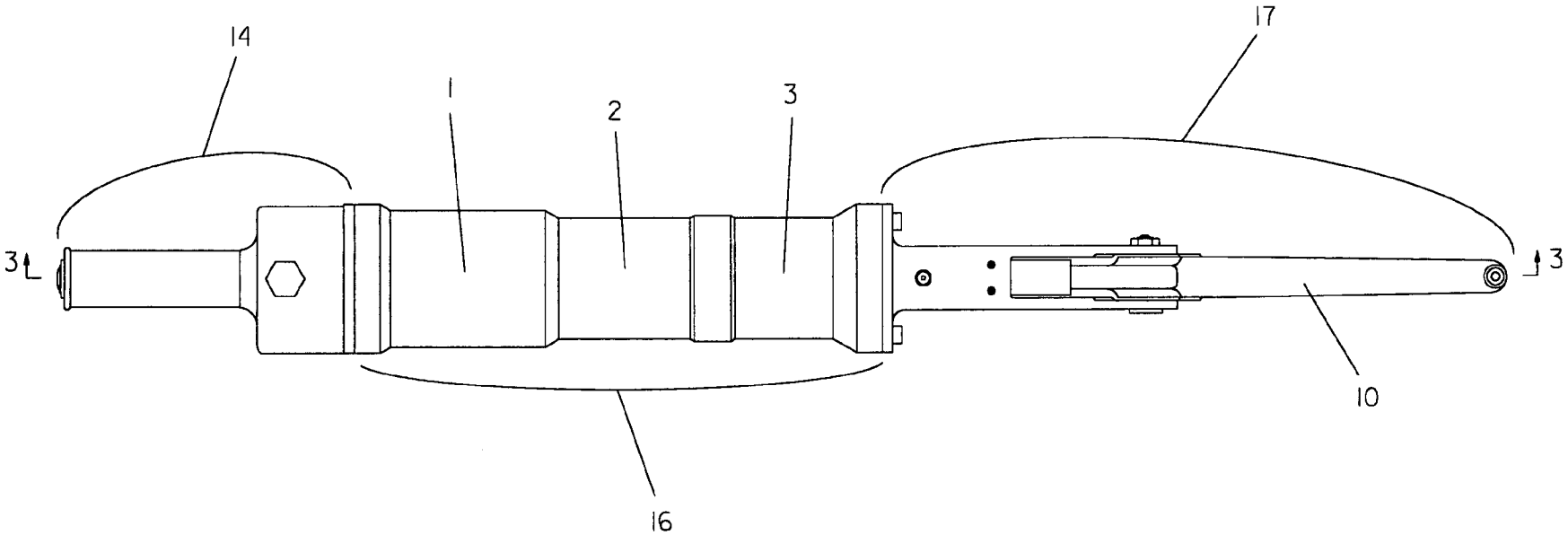
FIG. 2 is a top elevation view of an exemplary portable pneumatic compression riveter.
Figure 3:
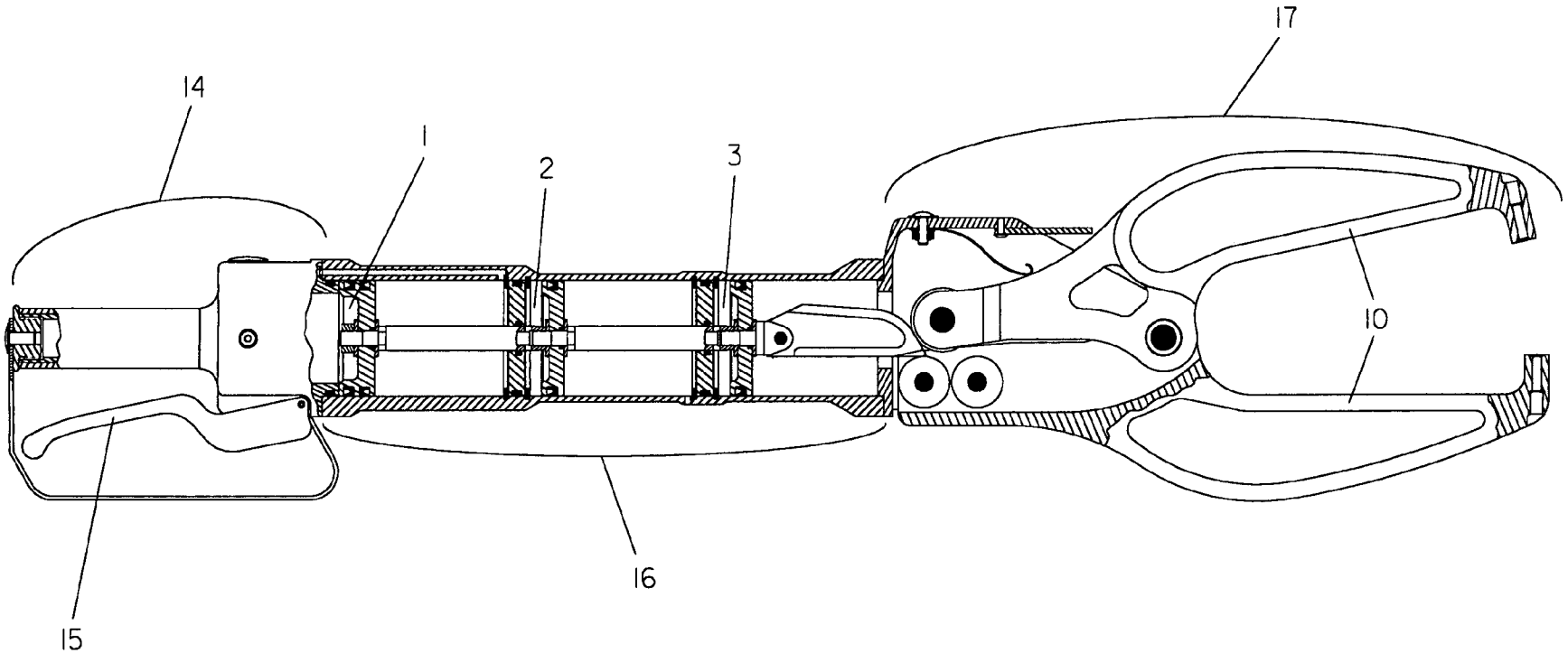
FIG. 3 is a fragmentary sectional view taken along viewing plane 3—3 of FIG. 2 of the portable pneumatic compression riveter prior to the valve's lever being actuated.
Figure 4:
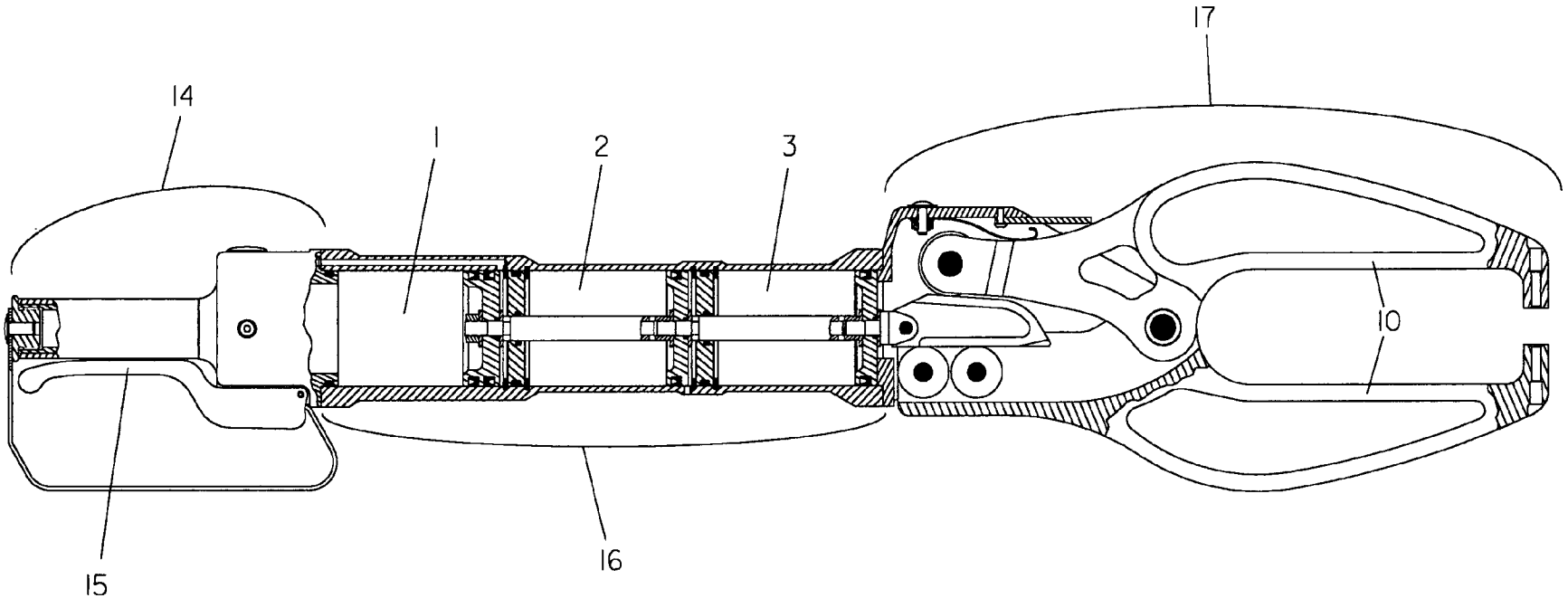
FIG. 4 is a fragmentary sectional view taken along viewing plane 3—3 of FIG. 2 of the portable pneumatic compression riveter after the valve's lever is actuated.

Referring first to FIGS. 1, 2, 3 and 4 an exemplary portable pneumatic compression riveter is depicted which includes a valve assembly 14, cylinder assembly 16 with more than one chamber (3 chambers in this representation identified here as chambers 1, 2 and 3), and a rivet head assembly 17. FIGS. 1, 2, 3 and 4 show the compression riveter fitted with an alligator set of jaws 10. The exemplary portable pneumatic compression riveter includes the preferred embodiments disclosed in this document. FIG. 3 shows the compression riveter prior to the lever 15 on the valve assembly 14 being actuated with the alligator jaw set 10 open. FIG. 4 shows the compression riveter with the lever 15 on the valve assembly 14 actuated and the alligator jaw set 10 closed. When the lever 15 is released the alligator jaw set 10 opens and the compression riveter resets as shown in FIG. 3.

Figure 5:
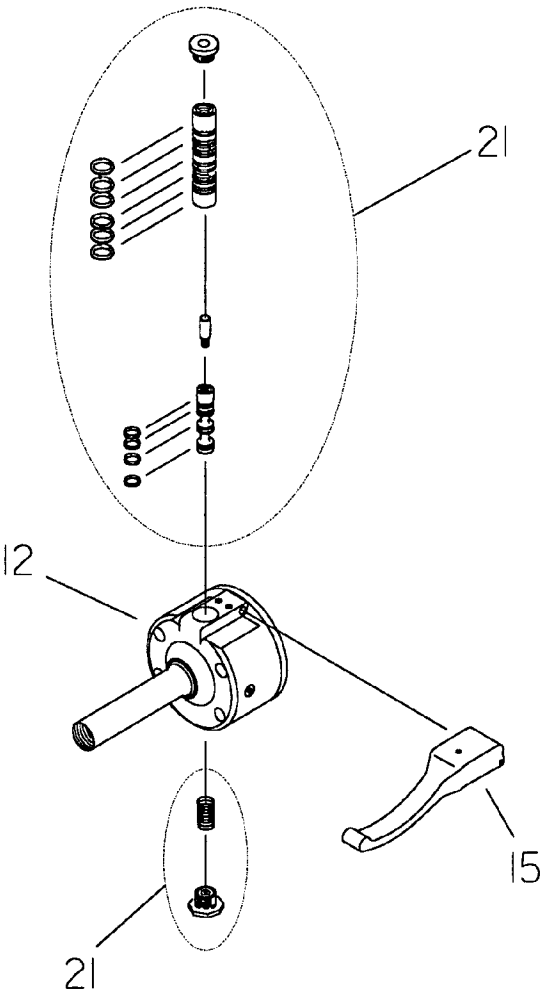
FIG. 5 is an exploded assembly view of the new composite valve body with the integrated handle.

Additionally, FIG. 5 shows the composite valve body 12 with the integrated handle. The composite valve body 12 is made of a composite material and houses the valve sleeve assembly 21. The lever 15 is used to actuate the valve sleeve assembly 21 inside the composite valve body 12.

Figure 6:
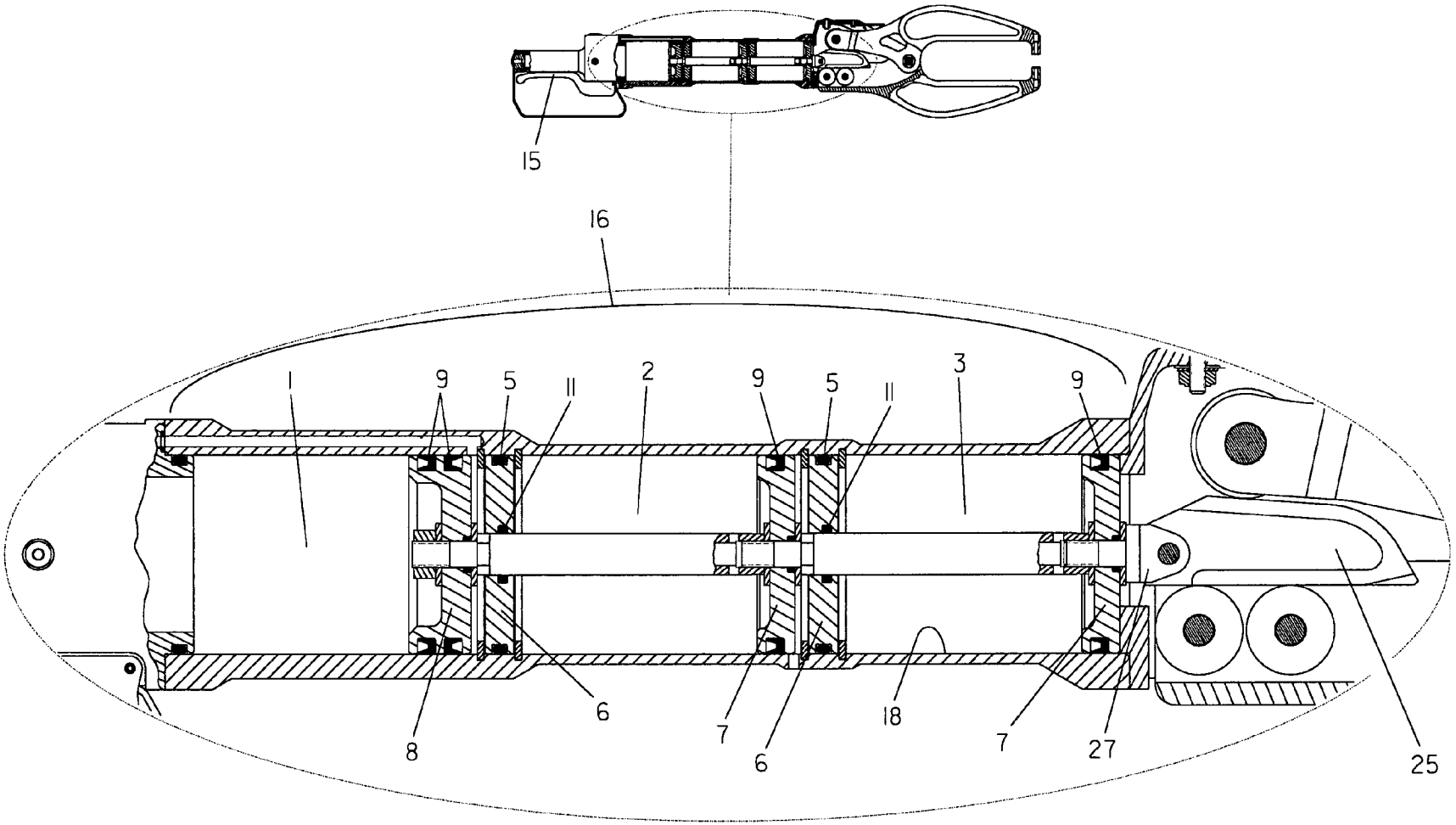
FIG. 6 is a fragmentary section view taken along viewing plane 3—3 of FIG. 2 of the portable pneumatic compression riveter showing the new composite pistons with u-ring seals.

Referring additionally to FIGS. 3, 4 and 6 the unidirectional composite pistons 7 and bi-directional composite piston 8 each have u-ring seals 9 with the bi-directional piston having two u-ring seals 9 installed opposing each other. When the lever 15 is actuated, compressed air enters the first and successive chambers (chambers 1, 2 and 3 in this representation) in the cylinder assembly 16 building pressure behind the stationary composite bulkheads 6 sealed with o-rings 5 and quad rings 11. The pistons 7 and 8 are driven forward forcing the wedge 25 pinned in the clevis 27 attached to the lead piston 7 into the rivet head assembly 17. As a result, the pistons 7 and 8 rub against the cylinder wall 18. The composite pistons 7 and 8 act as traditional wear rings and protect the cylinder wall 18 from excessive damage. The u-ring seals 9 allow for as much as 0.060 wear, in this example, to the piston's 7 and 8 outside diameter while still maintaining a full seal. This greatly exceeds the amount of dimensional change that a conventional o-ring—piston—cylinder arrangement in this type of tool can have and maintain its seal.

Figure 7:
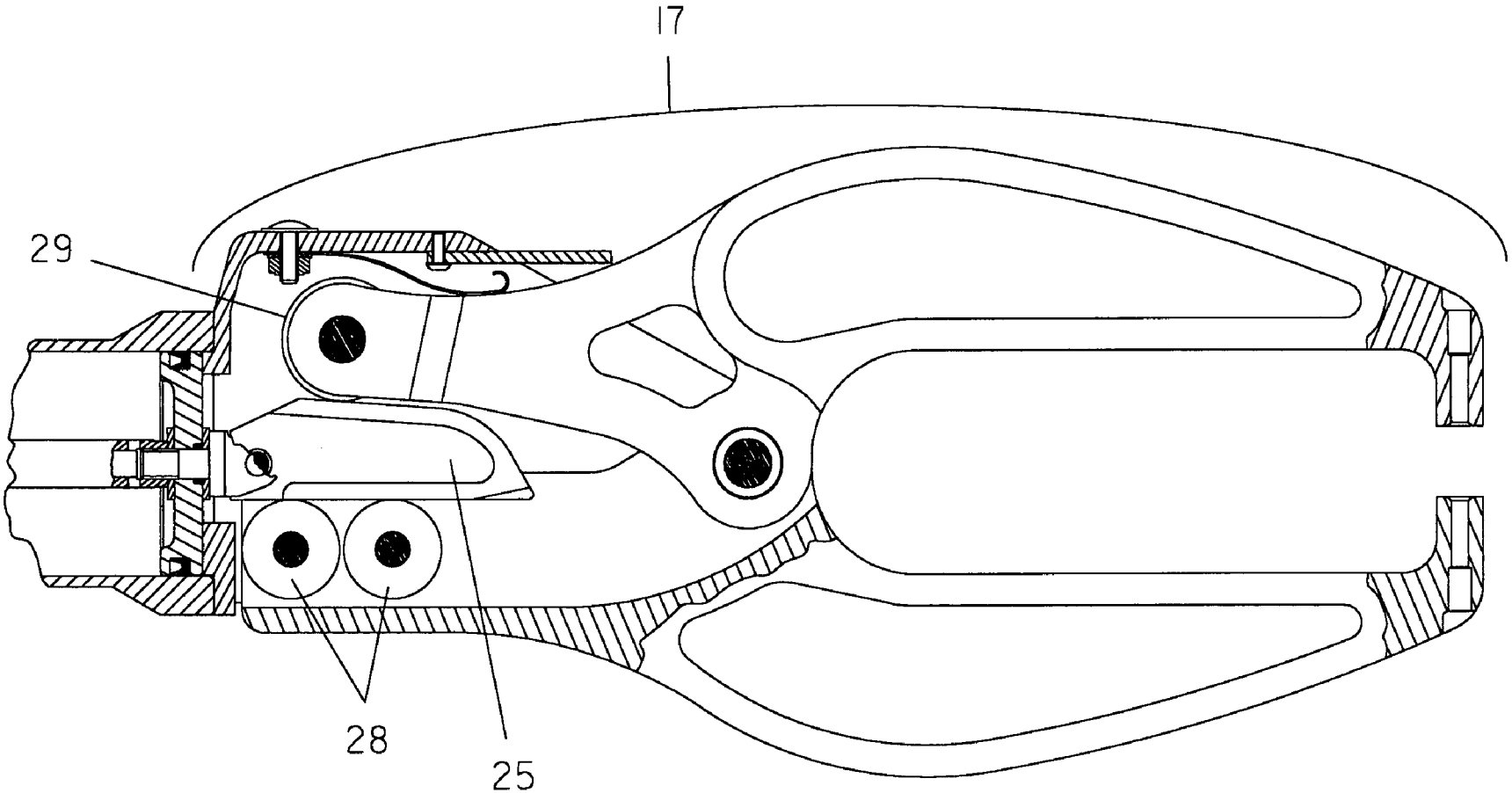
FIG. 7 is a fragmentary sectional view taken along viewing plane 3—3 of FIG. 2 of the portable pneumatic compression riveter of the wedge driven between the bearing sets in the rivet head assembly.
Figure 8:
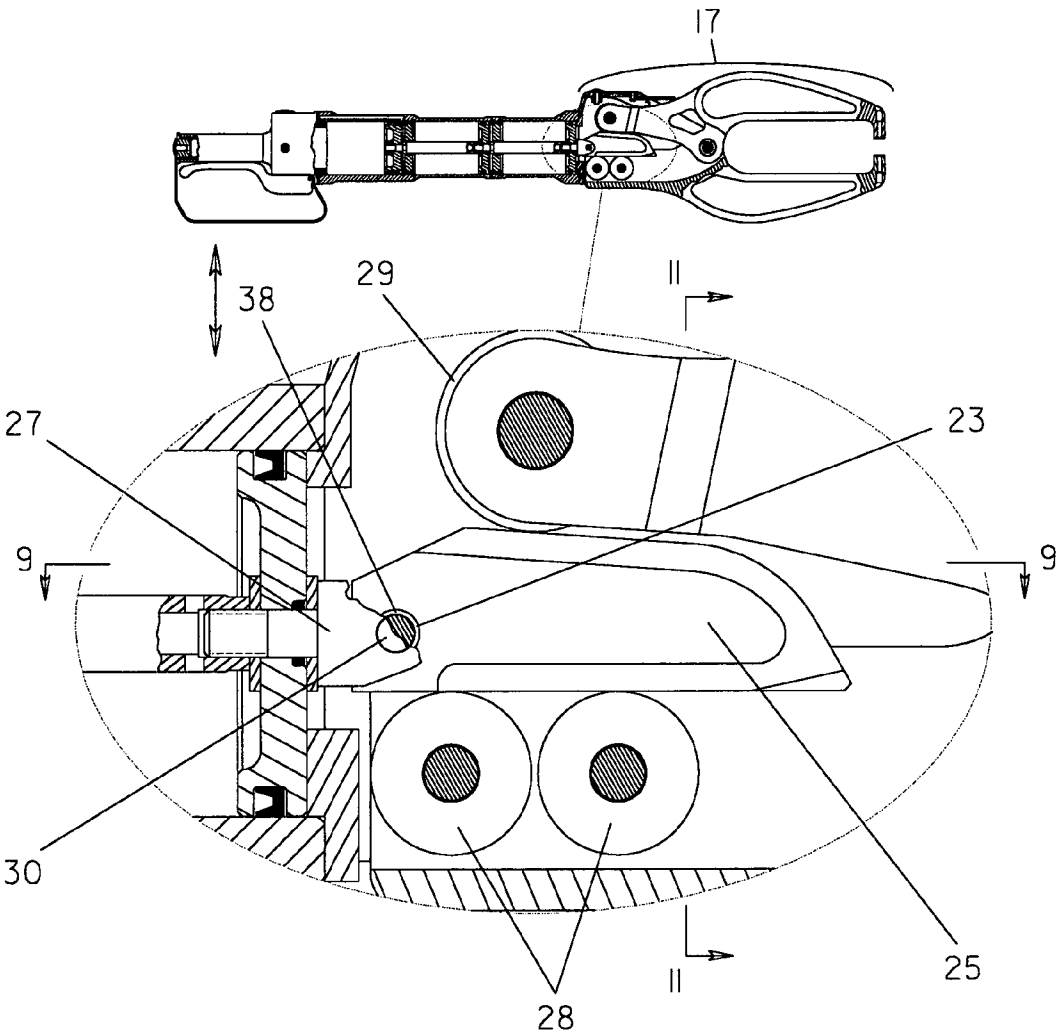
FIG. 8 is a fragmentary sectional view taken along viewing plane 3—3 of FIG. 2 of the portable pneumatic compression riveter showing the pin—clevis—wedge subassembly showing the vertical float of the wedge inside the rivet head assembly.
Figure 9:
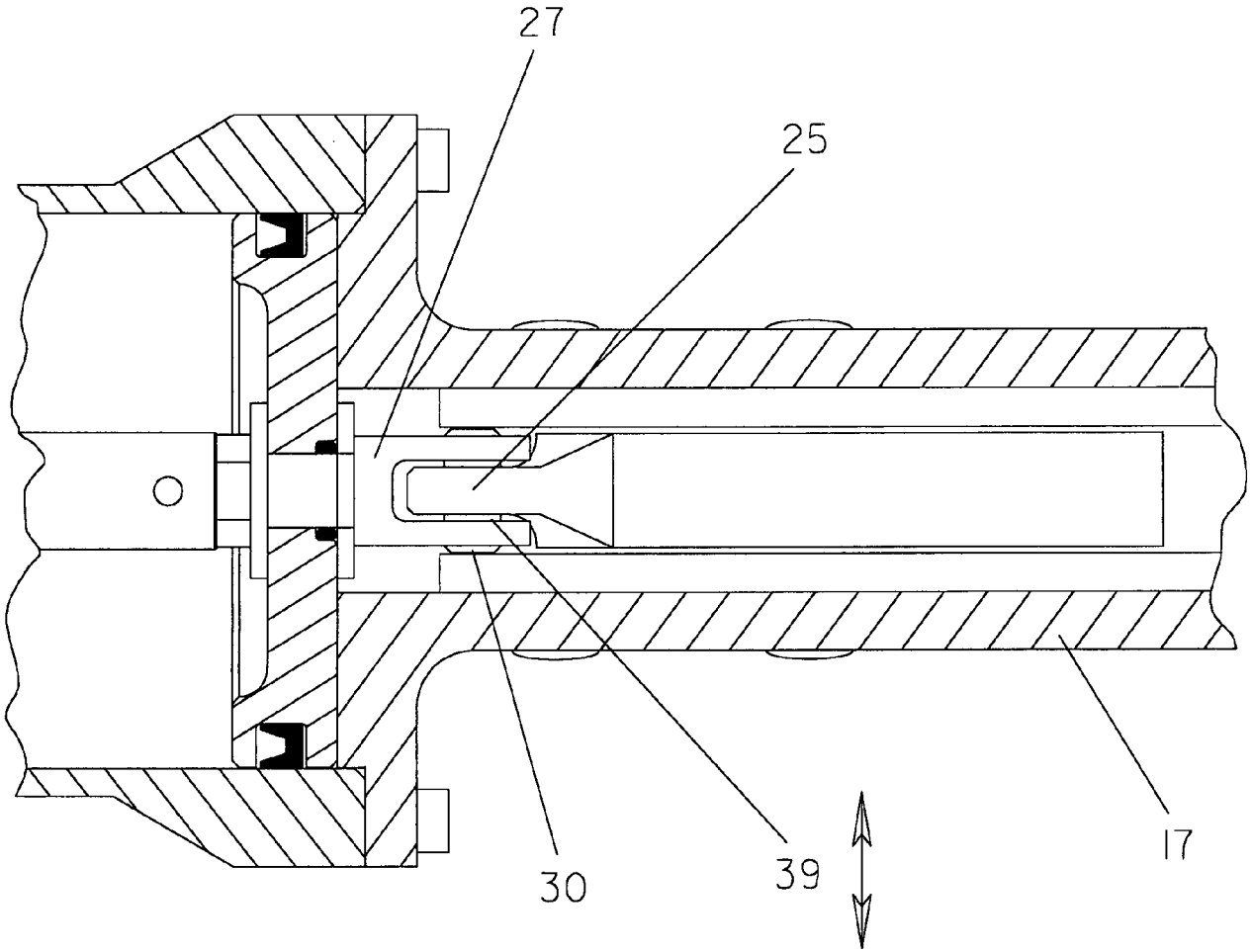
FIG. 9 is a top elevation fragmentary sectional view taken along viewing plane 9—9 of FIG. 8 of the pin—clevis—wedge subassembly showing the horizontal float of the wedge inside the rivet head assembly.
Figure 10:
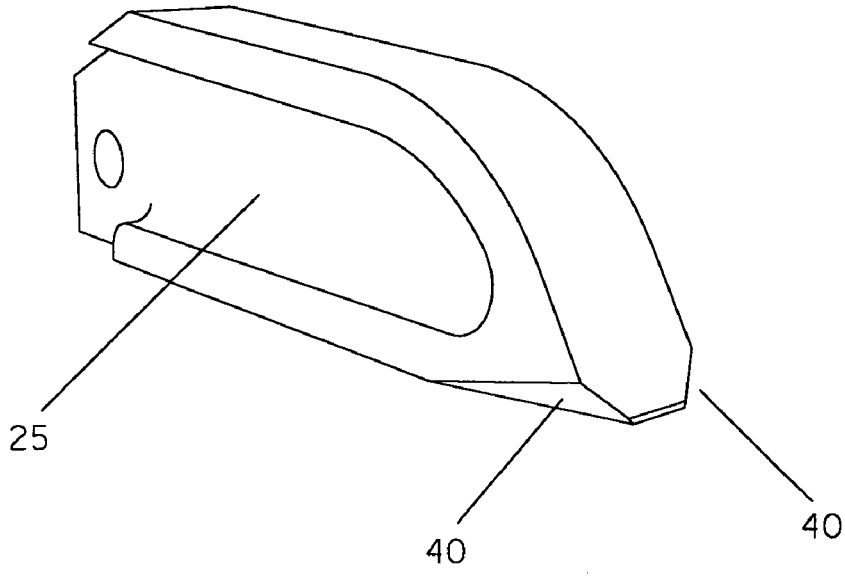
FIG. 10 is a prospective view of the wedge.
Figure 11:
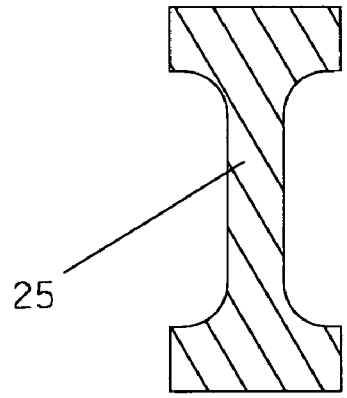
FIG. 11 is a sectional view taken along viewing plane 11—11 of FIG. 8 showing the cross section of the wedge.

Refer to FIGS. 7, 8 and 9 where the wedge 25 is driven between the bearings 28 and 29 on the rivet head assembly 17. FIG. 8 shows the hole 23 in the wedge 25 is larger than the pin 30 diameter in the clevis 27 allowing "vertical float" 38 to compensate for any misalignment of the wedge 25 with the bearings 28 and 29 positioned in the rivet head assembly 17. Refer additionally to FIGS. 8 and 9 where the width of the back of the wedge 25 at its attach point to the clevis 27 where the pin 30 attaches them is narrower than the clevis' 27 width. This allows for "horizontal float" 39 to compensate for any misalignment of the wedge with the rivet head assembly 17. Referring also to FIG. 10 an angled flat 40 on the front of the wedge 25 allows the wedge 25 to self align without binding as it moves forward into the rivet head assembly 17. Additionally, refer to FIGS. 8 and 11 where a cross section of the wedge 25 is presented. This light but rigid wedge design contributes to a significant reduction in the weight of the wedge 25 and contributes to a lighter compression riveter.

Figure 12:
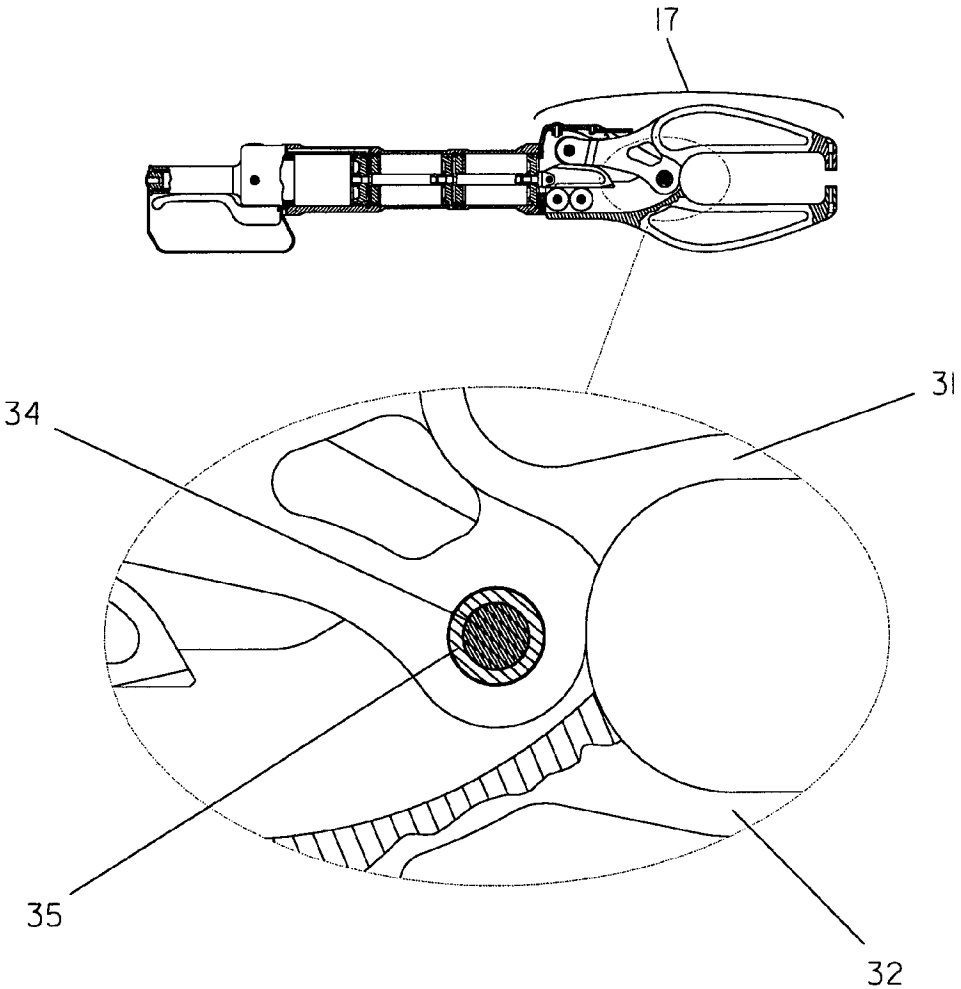
FIG. 12 is a fragmentary sectional view taken along viewing plane 3—3 of FIG. 2 of the portable pneumatic compression riveter showing the pivot pin area of the rivet head assembly.

FIG. 12 shows a sectional view of the pivot area 33 of the rivet head assembly 17. In the center is a hardened steel sleeve 35 that slip fits into the pivoting jaw 31 and is joined together with the fixed jaw 32 with a slip fit pivot pin 34. The hardened steel sleeve 35 avoids the problems encountered with a needle roller bearing in this application and contributes to a lighter more reliable and compact compression riveter.

Figure 13:
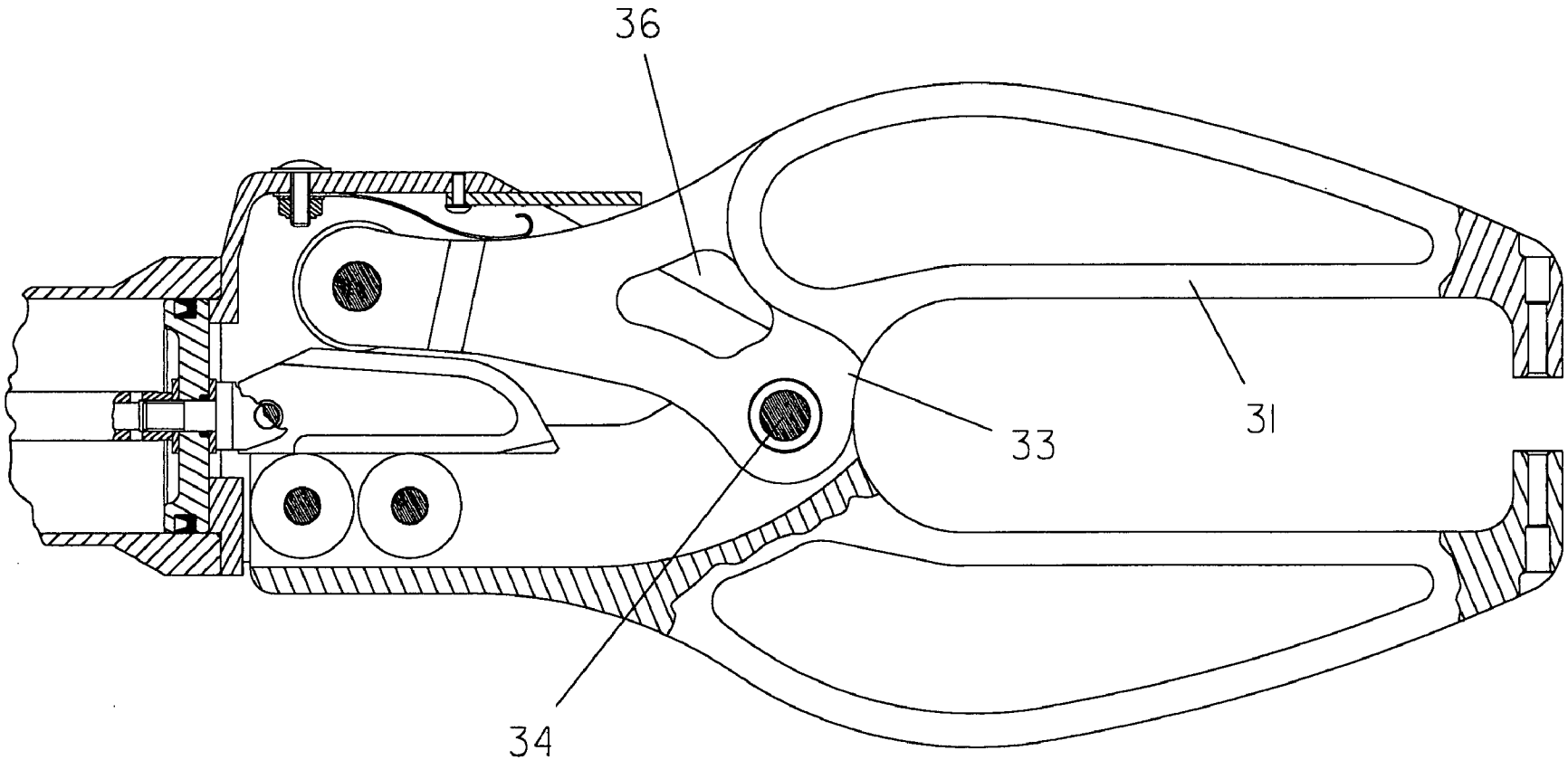
FIG. 13 is a fragmentary sectional view taken along viewing plane 3—3 of FIG. 2 of the portable pneumatic compression riveter showing the pivoting jaw with its hollow recess inside the rivet head assembly.

FIG. 13 shows another embodiment of the improvement to the portable pneumatic compression riveter where the pivoting jaw 31 has a hollow recess 36 behind the pivot pin 34. The hollow recess 36 provides a safe zone to arrest a crack in the pivoting jaw 31 propagating from the pivot area 33. This hollow recess 36 helps prevent a catastrophic failure caused by a crack propagating unchecked from the pivot area 33 allowing the forward portion of the pivoting jaw 31 to become a projectile. The hollow recess 36 also contributes to a lighter tool.

While the principles of the improvements have been shown and described in connection with preferred embodiments, it is to be understood clearly that such embodiments are by way of example and are not limiting.

What is claimed is:

1. A portable pneumatic compression riveter comprising:

a valve body constructed of a composite material, said valve body housed in a valve assembly used to actuate a portable pneumatic compression riveter by allowing compressed air to flow into an adjacent cylinder assembly of the compression riveter, a cylinder assembly provided adjacent to the valve assembly, the cylinder assembly provided with at least one chamber, a piston provided in each chamber so that compressed air flowing into the cylinder assembly from the valve assembly causes pressure to build up behind each piston and causes the piston to move toward an adjacent rivet head assembly, each piston sealed within its associated chamber by a bulkhead, all pistons attached to a single shaft so that the shaft moves with the pistons, a clevis attached to the shaft, a rivet head assembly provided adjacent to the cylinder assembly, said rivet head assembly having two jaws, one jaw in the head assembly being stationary and one jaw being pivotable about a center pin, a wedge movably provided within the rivet head assembly, said wedge pinned to the clevis so that the wedge moves with the shaft and pistons, the wedge movable between a set of bearing provided in the rivet head assembly and engaging a rear end of the pivoting jaw so that the pivoting jaw pivots and closes a forward end of the pivoting jaw with a forward end of the fixed jaw whenever the wedge extends between the set of bearings, the pistons constructed of a composite material, the composite pistons fitted with u-ring seals; the cylinder made of aluminum and without the benefit of a surface hardening treatment such as hard anodize on the interior; the outside diameter of the composite pistons being a wear ring so that the u-ring seals seal the gaps that form between the pistons and their associated cylinders.

2. The portable pneumatic compression riveter of claim 1 further comprising:

angled flats provided on the forward end of the wedge that allow the wedge to self align and compensate for piston wear as it is driven forward into the rivet head assembly.

3. The portable pneumatic compression riveter of claim 2 further comprising:

the cylinder assembly provided with an aluminum cylinder without the benefit of surface treatment such as hard anodize and having, composite pistons fitted with u-rings, and a self aligning wedge working together with the cylinder assembly as a system.

4. The portable pneumatic compression riveter A portable pneumatic compression riveter comprising:

a valve body constructed of a composite material, said valve body housed in a valve assembly used to actuate a portable pneumatic compression riveter by allowing compressed air to flow into an adjacent cylinder assembly of the compression riveter, a cylinder assembly provided adjacent to the valve assembly, the cylinder assembly provided with at least one chamber, a piston provided in each chamber so that compressed air flowing into the cylinder assembly from the valve assembly causes pressure to build up behind each piston and causes the piston to move toward an adjacent rivet head assembly, each piston sealed within its associated chamber by a bulkhead, all pistons attached to a single shaft so that the shaft moves with the pistons, a clevis attached to the shaft, a rivet head assembly provided adjacent to the cylinder assembly, said rivet head assembly having two jaws, one jaw in the head assembly being stationary and one jaw being pivotable about a center pin, a wedge movably provided within the rivet head assembly, said wedge pinned to the clevis so that the wedge moves with the shaft and pistons, the wedge movable between a set of bearing provided in the rivet head assembly and engaging a rear end of the pivoting jaw so that the pivoting jaw pivots and closes a forward end of the pivoting jaw with a forward end of the fixed jaw whenever the wedge extends between the set of bearings, and a hardened steel sleeve is slip fit into the pivoting jaw, serving as the sole bearing at the pivot pin.

5. A portable pneumatic compression riveter comprising:

a valve body constructed of a composite material, said valve body housed in a valve assembly used to actuate a portable pneumatic compression riveter by allowing compressed air to flow into an adjacent cylinder assembly of the compression riveter, a cylinder assembly provided adjacent to the valve assembly, the cylinder assembly provided with at least one chamber, a piston provided in each chamber so that compressed air flowing into the cylinder assembly from the valve assembly causes pressure to build up behind each piston and causes the piston to move toward an adjacent rivet head assembly, each piston sealed within its associated chamber by a bulkhead, all pistons attached to a single shaft so that the shaft moves with the pistons, a clevis attached to the shaft, a rivet head assembly provided adjacent to the cylinder assembly, said rivet head assembly having two jaws, one jaw in the head assembly being stationary and one jaw being pivotable about a center pin, a wedge movably provided within the rivet head assembly, said wedge pinned to the clevis so that the wedge moves with the shaft and pistons, the wedge movable between a set of bearing provided in the rivet head assembly and engaging a rear end of the pivoting jaw so that the pivoting jaw pivots at a pivot area and closes a forward end of the pivoting jaw with a forward end of the fixed jaw whenever the wedge extends between the set of bearings, the pivoting jaw provided with a hollow recess above and behind the pivot area with the intent of arresting a crack originating from the pivot area and reducing the chance of catastrophic failure of the pivoting jaw.

* * * * *